US007453433B2

(12) United States Patent
Kudo et al.

(10) Patent No.: US 7,453,433 B2
(45) **Date of Patent: *Nov. 18, 2008**

(54) LIQUID CRYSTAL DISPLAY CONTROLLER

(75) Inventors: Yasuyuki Kudo, Kamakura (JP); Tsutomu Furuhashi, Yokohama (JP); Yoshikazu Yokota, Kodaira (JP); Toshimitsu Matsudo, Shinagawa (JP); Atsuhiro Higa, Yokohama (JP)

(73) Assignee: Renesas Technology Corp., Tokyo (JP)

( * ) Notice: Subject to any disclaimer, the term of this patent is extended or adjusted under 35 U.S.C. 154(b) by 338 days.

This patent is subject to a terminal disclaimer.

(21) Appl. No.: 11/172,563

(22) Filed: Jun. 29, 2005

(65) Prior Publication Data

US 2005/0243051 A1 Nov. 3, 2005

Related U.S. Application Data

(63) Continuation of application No. 09/891,677, filed on Jun. 25, 2001, now Pat. No. 7,068,253.

(30) Foreign Application Priority Data

Jul. 26, 2000 (JP) ..... 2000-231351
Oct. 4, 2000 (JP) ..... 2000-309300

(51) Int. Cl.
*G09G 3/36* (2006.01)
*G09G 5/10* (2006.01)

(52) U.S. Cl. ..... 345/99; 345/100; 345/211; 345/690

(58) Field of Classification Search ..... 345/89, 345/99–100, 211, 690, 698, 699, 51, 98, 345/208, 212–214
See application file for complete search history.

(56) References Cited

U.S. PATENT DOCUMENTS 6,014,126 A * 1/2000 Nishihara ..... 345/698
6,020,872 A * 2/2000 Mizukata et al. ..... 345/99
6,304,242 B1 * 10/2001 Onda ..... 345/99

FOREIGN PATENT DOCUMENTS

JP 2-58793 4/1990
JP 08-054600 A 2/1996
JP 08-221032 A 8/1996
JP 11-311980 9/1999
JP 2000/132135 5/2000

* cited by examiner

*Primary Examiner*—Henry N Tran
(74) *Attorney, Agent, or Firm*—Townsend and Townsend and Crew LLP

(57) ABSTRACT

The present invention provides a liquid crystal display controller device and method which provides for a full and/or partial display with good display quality and/or low power consumption based on the scanning period for an active scan line being dependent upon a number of reference clock pulses. Some embodiments of the present invention include one or more of the following features: keeping the frequency substantially constant for different numbers of active scan lines, allowing change of the frequency due to characteristics of the LCD, displaying gradation with near linear effective voltage characteristics, displaying graduation data with lower power, or displaying a partial or full screen in a mobile device, for example, a cell phone.

3 Claims, 17 Drawing Sheets

FIG.1

210

| NO. of active lines (M) | Division ratio (R) | No. of reference clocks per scanning period (N) | Frame frequency |
|---|---|---|---|
| 160 | 1 | 18 | 69.4 Hz |
| 130 | 1 | 22 | 69.9 Hz |
| 100 | 1 | 28 | 71.4 Hz |
| 70 | 2 | 20 | 71.4 Hz |
| 40 | 4 | 18 | 69.4 Hz |
| 10 | 16 | 18 | 69.4 Hz |
| 160 | 1 | 21 | 59.5 Hz |
| 130 | 1 | 26 | 59.2 Hz |
| 100 | 1 | 33 | 60.6 Hz |
| 70 | 2 | 24 | 59.5 Hz |
| 40 | 4 | 21 | 59.5 Hz |
| 10 | 16 | 21 | 59.5 Hz |

FIG.3

| Signal name | Meaning | "Low" | "High" |
|---|---|---|---|
| CS | chip select | accessible | inaccessible |
| RS | register address/data selection | address | data |
| E | data write/read activation | active | inactive |
| RW | data write/read selection | write | read |
| D | interactive data | — | — |

LIQUID CRYSTAL DISPLAY CONTROLLER

CROSS-REFERENCES TO RELATED APPLICATIONS

This application is related to and claims priority from Japanese Application No. 2000-309300, filed on Oct. 4, 2000 and Japanese Application No. 2000-231351, filed on Jul. 26, 2000.

BACKGROUND OF THE INVENTION

The present invention relates to a liquid crystal display (LCD) controller.

An example of a liquid crystal display controller is disclosed by JP-A-No. 11-311980. The controller can drive part of the liquid crystal display selectively as well as can set the operating voltage, operation bias, and reference clock frequency according to the number of active lines in the selected part. This means that when the entire screen need not be displayed, only the required part of the screen can be displayed under proper operating conditions. This leads to reduction in electric power consumption.

In the prior art, the frame frequency is held constant by varying the ratio of division of the original clock depending on the number of active lines and using the resulting clock as the reference clock.

Assume that 16 lines are activated for a partial display in a liquid crystal panel, for example, where on the basis of eight lines per row, the whole screen has 32 lines (4 rows). In this case, if the reference clock frequency is constant, the frame frequency doubles since the time for activating 16 lines is half that for 32 lines. As a result, the image quality may deteriorate, for example, shadowing may occur. To avoid this, the original clock is halved or divided into two clocks and the resulting clock is used as the reference clock to hold the frame frequency constant. Likewise, by dividing the original clock into four or eight clocks, the frame frequency can be held constant for a partial display of eight lines (two rows) or four lines (one row).

Recently there is an increasing tendency for liquid crystal panels in cellular phones or similar devices to use more than 100 display lines. Also there is demand for the number of lines per row to be other than 8, such as for a partial display. However, the number of lines for a partial display to hold the frame frequency constant is limited to ½, ¼, ⅛ and so on of that for the full screen display; therefore it is difficult to hold the frame frequency constant without limitations on the number of active lines.

The optimum frame frequency may differ depending on the characteristics of the liquid crystal panel. For example, if a liquid crystal with quick brightness response is used, generally the frame frequency must be increased to obtain a satisfactory contrast, though a higher frame frequency leads to an increase in power consumption. One solution is to make the frame frequency variable depending on the application purpose, for example, by preparing two modes: a contrast-oriented mode and a power saving mode. However, conventional liquid crystal display controllers are not designed to change the frame frequency depending on the operating mode of the liquid crystal display unit.

For cellular phones with liquid crystal displays, mobile communication terminals with scheduling functions and other similar devices, there is growing demand for a model which can be used for an extended time with less power consumption. In the standby or waiting state of a cellular phone or when a mobile communication terminal is in operation, there is a need to display not the whole screen but, for example, part of the screen needed for the clock.

Thus there is a need for a liquid crystal display controller that can provide a full/partial display with good display quality and/or low power consumption. In addition there is a need for both keeping the frame frequency constant and for varying it under a wider range of conditions.

SUMMARY OF THE INVENTION

The present invention provides a liquid crystal display controller device and method which provides for a full and/or partial display with good display quality and/or low power consumption based on the scanning period for an active scan line being dependent upon a number of reference clock pulses. Some embodiments of the present invention include one or more of the following features: keeping the frequency substantially constant for different numbers of active scan lines, allowing change of the frequency due to characteristics of the LCD, displaying gradation with near linear effective voltage characteristics, displaying graduation data with lower power, or displaying a partial or full screen in a mobile device, for example, a cell phone.

In the liquid crystal display controller according to a first embodiment of the present invention, a register is provided to preset the original clock division ratio and the number of clocks for one scanning period and preset data can be entered into the register from outside. This makes it possible to hold the frame frequency almost constant with different numbers of active lines and to change the frame frequency easily.

In the liquid crystal display controller according to a second embodiment of the present invention, when a PWM-based gradation display function is provided, one scanning period is divided into an effective period and an ineffective period, where the data voltage with a suitable time length for display data and a selected voltage level for scanning signals are given during the effective period only. This makes it possible to obtain linear effective voltage characteristics with respect to gradation display data even when the number of clocks for one scanning period is varied.

The liquid crystal display controller according to a third embodiment of the present invention provides various data signal waveforms for PWM to realize power consumption reduction and high display image quality.

The liquid crystal display controller according to a forth embodiment of the present invention is used in a cellular phone system. Even if display data for a desired part of the screen changes during standby, a high quality image is provided with low power consumption.

In another embodiment of the present invention a method for changing a scanning period used in a liquid crystal display is provided. First, a reference clock period is determined from a first number of original clock periods; next the scanning period is determined from a second number of reference clock periods; and the scanning period may be changed by at least one reference clock period.

In yet another embodiment a cellular phone system is provided which includes: a liquid crystal panel for displaying a partial screen display, having a first predetermined number of active lines, and a full screen display, having a second predetermined number of active lines; a liquid crystal display controller for controlling at least a display of an active line period on the liquid crystal panel; and a processor for determining a first active line period for the partial display and a second active line period for the full display, such that a first frame frequency for the partial display is approximately equal to a second frame frequency for the full screen display.

In an alternative embodiment a cellular phone system is provided having: a liquid crystal panel for displaying a full screen display, including a predetermined number of active lines; a liquid crystal display controller for controlling at least a display of an active line period on the liquid crystal panel, wherein the active line period includes a number of reference clock periods, wherein each reference clock period includes a division ratio multiplied by an original clock period; and a processor for determining a first active line period for a contrast oriented mode having a predetermined frame frequency and a second active line period for a stand-by mode having a lower predetermined frequency.

A method for maintaining a frame frequency at a substantially constant value for a liquid crystal display, having different numbers of active scan lines, is provided in another embodiment of the present invention. The method includes: selecting a first number of the different numbers of scan lines, wherein each scan line period for the first number is based on a second number of reference clock periods; and determining the second number such that the inverse of a product is substantially equal to the frame frequency, wherein the product has the first number multiplied by the second number multiplied by a reference clock period. In addition the reference clock period may be a division ratio multiplied by an original clock period.

An alternative method for changing a frame frequency of a liquid crystal display having a predetermined number of scan lines, of an embodiment of the present invention is provided. The method includes: determining a scan line period for the frame frequency, wherein the frame frequency equals an inverse of a product, the product having the scan line period times the predetermined number of scan lines; selecting a new frame frequency; and determining a new scan line period for the new frame frequency, wherein the new frame frequency equals an inverse of a new product, the new product including the new scan line period times the predetermined number of scan lines These and other embodiments of the present invention are described in more detail in conjunction with the text below and attached figures.

BRIEF DESCRIPTION OF THE DRAWINGS

FIG. 1 is a table suggesting settings related to frame frequencies according to the first embodiment of the present invention;

FIG. 3 illustrates control signals according to the first embodiment of the present invention;

DESCRIPTION OF THE SPECIFIC EMBODIMENTS

Figure 2:
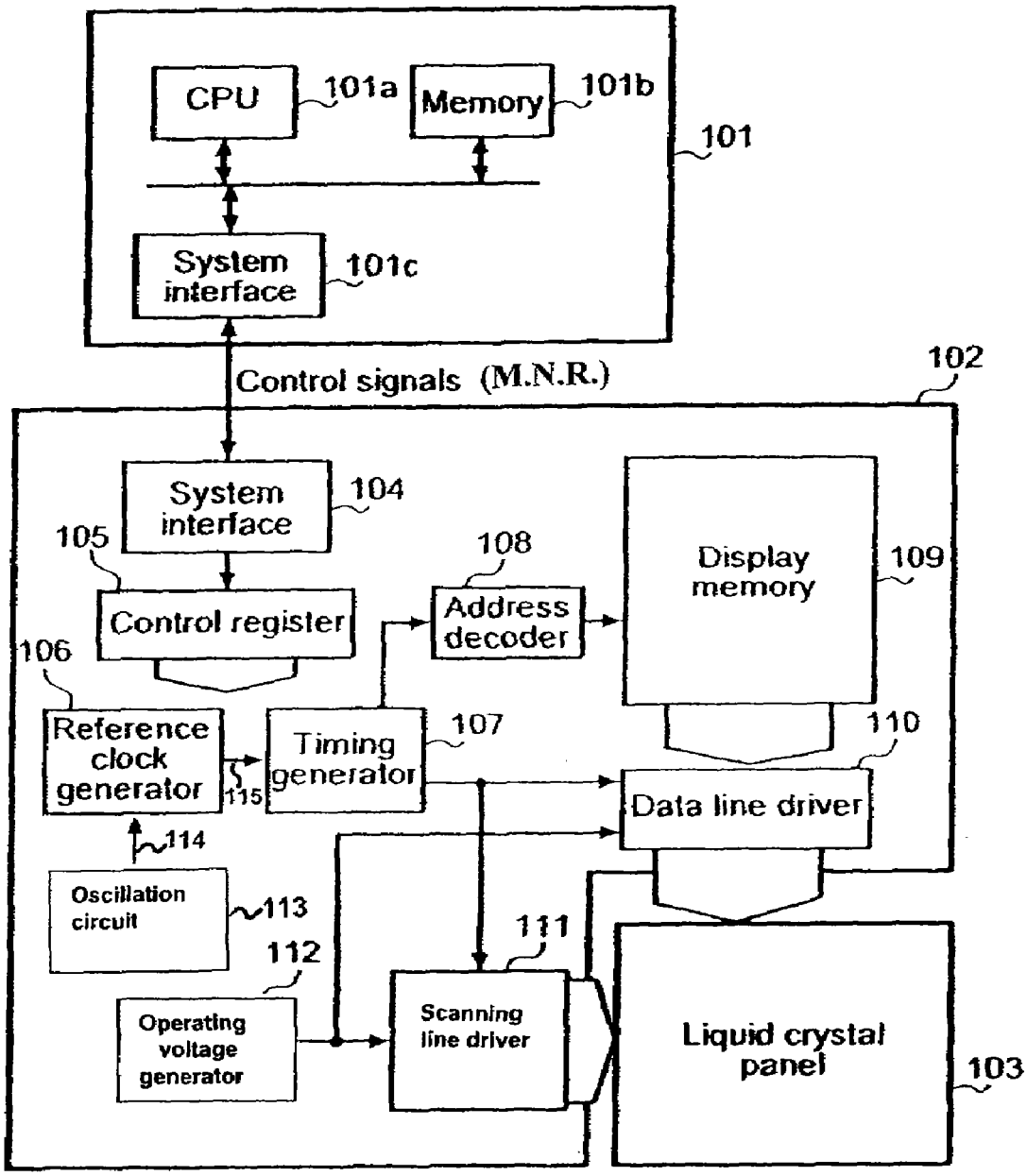
FIG. 2 is a block diagram illustrating the structure of a liquid crystal display controller according to the first embodiment of the present invention.

In order to keep the frequency relatively constant for different numbers of active scan lines, the scanning period, i.e., the time it takes to display one active line on a LCD, is based on the number of reference clocks per scanning period or "N" 216 and the division ratio of the original clock or "R" 214. Thus if the original clock period is "T" then the scanning period is (R×T×N).

The frame frequency 218 is determined from one scanning period, (R×T×N), and the number of active lines or "M" 212, using equation 1.

$$\text{Frame frequency}=1/((R\times T\times N)\times M) \qquad \text{[Equation 1]}$$

As can be understood from Equation 1, if the number of active lines is to be changed with the frame frequency constant, the length of one scanning period should be adjusted.

FIG. 1 is a table showing examples of various settings related to reference clocks which keep the frame frequency around 60 Hz or 70 Hz. The frequency 60 Hz is for a normal display, while the frequency 70 Hz is for a high contrast display. In this table, it is assumed that the original clock frequency is 200 kHz (i.e., 1/T=200 kHz or T=5 μsec) and the number of active lines for a full screen display is 160. From FIG. 1 the no. of active lines is M 212, the division ratio R 214, the no. of reference clocks per scanning period N 216, and the corresponding Frame Frequency is given by column 218. For example with M=160 220, R=1 222, N=18, the Frame Frequency is 69.4 Hz 226. For M=70 230, R=2 232, N=20 234, the Frame frequency is 71.4 Hz 236. As can be seen from FIG. 2, it is possible to keep the frame frequency virtually constant even when the number of active lines (M) is varied. Thus given the frame frequency 218 and the number of active lines M 212 in a full or partial display, the division ratio and number of reference clocks N can be determined to give the desired frame frequency. According to one embodiment a liquid crystal display controller provides a into which such preset data as the ratio of division of the original clock (R) and the number of clocks per scanning period (N) can be inputted.

FIG. 1 also shows that it is fairly easy to change the frame frequency. For example, rather that a high contrast display, a normal contrast display with 60 Hz is used. For M=70 240, R=2 242, the frame frequency 59.5 Hz can be achieved by changing the number of reference clocks to N=24 244.

FIG. 2 is a block diagram for a liquid crystal display controller 102 according to an embodiment of the present invention. In FIG. 2, external device 101 is an example of a computer, which includes a CPU (central processing unit) 101*a*, a memory 101*b*, a bus connecting the CPU 101*a* and memory 101*b*. The computer 101 is connected to a liquid crystal display controller 102; and the controller 102 is connected to a "passive matrix type" liquid crystal panel 103 in which pixels are formed at intersections of plural scanning lines and data lines. The liquid crystal display controller included a system interface 104, a control register 105, a reference clock generator 106, a timing generator 107, an address decoder 108, a display memory 109, a data line driver 110, a scanning line driver 111, and an operating voltage generator 112.

First, the basic operations of the computer 101, liquid crystal display controller 102, and liquid crystal panel 103 will be explained.

The computer 101 gives display data to display images on the liquid crystal panel 103 as well as various operating parameters for the liquid crystal panel to the liquid crystal display controller 102. These operating parameters include not only such information as number of active lines, operating voltage, and operation bias but also information on original clock division ratios and number of clocks per scanning period which characterizes one embodiment of the present invention. The operation is executed by the computer or external data processor 101 according to the operating system for controlling the entire controller and the application software, both of which are stored in the memory 101*b*. Therefore, the memory 101*b* contains a table as shown in FIG. 1 which indicates correlations among No. of active lines, division ratios, and reference clock counts for one scanning period. The computer 101 determines the division ratio and No. of reference clocks per scanning period depending on the frequency and the number of lines to be activated and sends them to the liquid crystal display controller 102 as operating parameters. One program example is as follows: when the operator makes an entry into the controller, new display data will be given to make a display corresponding to the entry, or when a certain period of time has elapsed without any entry from the operator, a new operating parameter will be given to change the number of active lines.

The liquid crystal display controller 102 stores the display data and various operating parameters given by the external data processor 101 in the display memory 109 and the control register 105, respectively. According to the stored operating parameters, it reads the display data from the display memory 109, converts it into data signal and outputs it as data line operating voltage to be supplied to data lines. Also, it outputs scanning operating voltage for scanning lines to be scanned depending on the data lines activated by the data operating voltage. Therefore, frequency and other operating conditions which are varied by control of data and scanning line operating voltages for display depend on operating parameters.

The liquid crystal panel 103 displays images by inputting the data line operating voltages and scanning line operating voltages given by the liquid crystal display controller 102, to the data lines and scanning lines, respectively. It is assumed here that the waveforms for data line operating voltages and scanning line operating voltages are in accordance with liquid crystal operating voltage waveforms stated on pp. 394-399 of the Liquid Crystal Device Handbook, edited by the 142nd Committee of the Japan Society for the Promotion of Science and published by Nikkan Kogyosha.

With the above-mentioned structure and operational sequence, the original clock division ratio and the number of clocks per scanning period can be set from outside and the liquid crystal panel can be operated according to these settings. Consequently, different numbers of active lines can be used with the frame frequency almost constant so that as many scanning lines in the display panel as desired can be activated, displaying good quality images on the display panel.

Next, how the liquid crystal display controller 102 works will be explained in detail.

Figure 4:
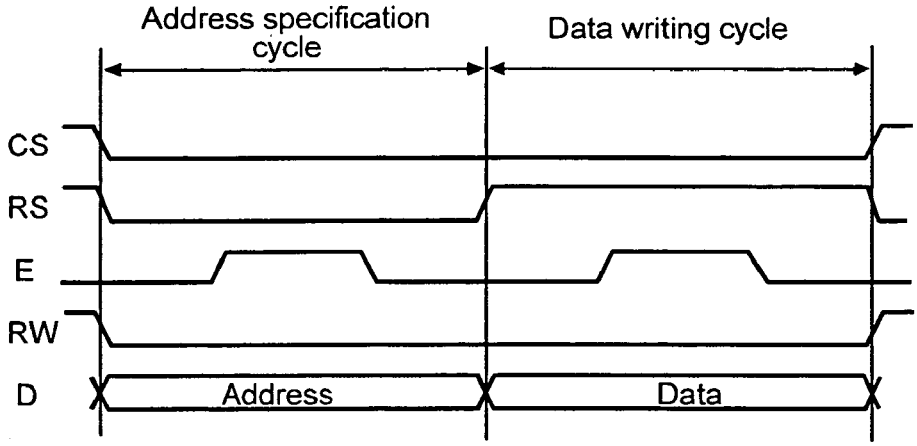
FIG. 4 is a timing diagram for control signals according to the first embodiment of the present invention.

Interfacing for the external data processor 101 conforms, for example, to the MC68-series bus interfaces; the liquid crystal display controller 102 receives information on an alteration to display data from the external data processor 101. More specifically, when for each pixel, the gradation of the present frame is different from that of the preceding frame, the external data processor 101 sends the liquid crystal display controller 102 display data for the new gradation, but not display data for the pixels whose gradation steps do not change. As shown in FIG. 3, interfacing between the system interface 101C of the external data processor 101 and the system interface 104 of the liquid crystal display controller 102 uses the following control signals: a CS or chip select signal; a RS signal, which selects either the address or data for the control register; an E signal, which specifies whether or not to start operation; an RW signal, which selects either data write or read; and a D signal, which specifies the actual address/data value. These control signals have a cycle for specifying an address in the control register 105 and a cycle for writing data. How the control signals work in these cycles are explained next by reference to FIG. 4. In the address specification cycle, first the CS signal, RS signal and RW signal are set at "low" and the D signal is set at a specific address value; then the E signal is set at "high" for a certain period. In the data writing cycle, first the CS signal is set at "low," the RS signal at "high," the RW signal at "low," and the D signal at the desired data value; then the E signal is set at "high" for a certain period.

The system interface 104 decodes the above-said control signals; it outputs, in the address specification cycle, the signal to make the relevant address ready for writing, and, in the data writing cycle, the data to be written, to the control register 105.

In the control register 105, the register area at the specified address is ready for writing and data is stored in this register area. Various operating parameters, display data and display position data are written at different addresses in the control register 105. In short, the various operating parameters and display data given by the data processor 101 are once stored in the control register 105. Various data stored in the control register 105 are outputted to various blocks.

The reference clock generator 106 receives original clock division ratio data from the control register 105 and divides the original clock 114 according to this data to generate reference clocks 115, which are then sent to the timing generator 107. The original clock 114 is generated by the built-in oscillation circuit 113.

The timing generator 107 receives not only reference clocks 115 but also data on the number of reference clocks 115 for one scanning period and the number of active lines from the control register 105, and generates line pulses synchronized with one scanning period and frame pulses synchronized with one frame period according to the received data and outputs them to the data line driver 110 and the scanning line driver 111. At the same time, it generates a display memory read address and outputs it to the address decoder 108.

For writing display data, the address decoder 108 decodes the display position data given by the control register 105 and selects the bit line and word line on the display memory 109 corresponding to it. Then, it outputs the display data given by the control register 105 to a data line on the display memory 109 to complete the writing operation. For reading, it decodes the read address from the timing generator 108 and selects the corresponding word line on the display memory 109. Then, display data for one line is outputted from the data line on the display memory 109 all at once. Read addresses as mentioned above are changed line by line, for instance, starting from the address where data for the top line on the screen is stored, and after reaching the address for the last line, this cycle is repeated again from the top line address. The address change is synchronized with the line pulse outputted from the timing generator 117 and output of the address for the top line is synchronized with the frame pulse outputted from the timing generator 117. The address decoder 108 has a coordinating function to decide whether to prioritize a write operation or a read operation if they occur simultaneously.

The data line driver 110 converts the display data read from the display memory 109 into prescribed ON or OFF voltage and outputs it as data line operating voltage to a data line on the liquid crystal panel 103. Data line operating ON and OFF voltages are generated by the operating voltage generator 112.

Frame and line pulses are inputted to the scanning line driver 111, and according to these signals, selected or non-selected voltage is outputted as scanning line operating voltage to a scanning line on the liquid crystal panel 103. The scanning line operating voltage is applied synchronously with the frame pulse to give the selected voltage to the top line; then it is applied to subsequent lines synchronously with line pulses. Except when scanning line operating voltage is applied, the non-selected voltage is always applied. The selected and non-selected voltages for activation of scanning lines are both generated by the operating voltage generator 112.

In the operating voltage generator 112, ON and OFF voltages for data line activation and selected and non-selected voltages for scanning line activation are generated from an external system power supply. The operating voltage generator 112 receives operating voltage and operation bias data from the control register 105 and the level of operating voltage is adjusted according to this data.

Figure 5:
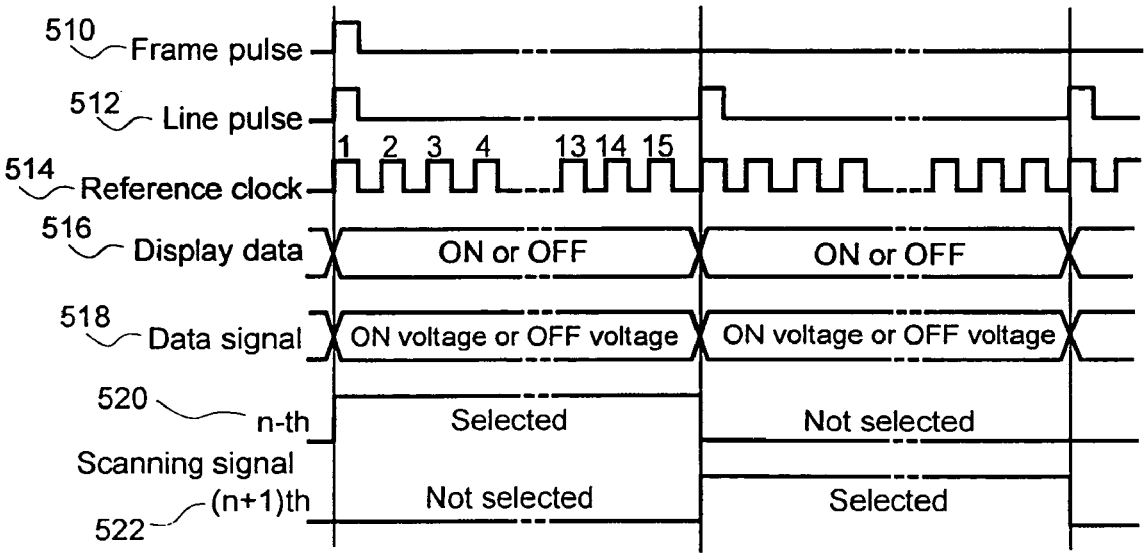
FIG. 5 is a timing diagram illustrating the operation of the liquid crystal display controller according to the first embodiment of the present invention.

FIG. 5 is a timing diagram for the above-mentioned frame pulse 510, line pulse 512, reference clock 514, display data 516, data signal 518, and scanning signals 520 and 522. Here, it is assumed that the number of reference clocks for one scanning period is 15.

As mentioned above, given data concerning the clock division ratio and the number of clocks for one scanning period from the external data processor 101, the liquid crystal display controller 102 works so that the liquid crystal panel 103 can be driven at the desired frame frequency according to this data. Therefore, the frame frequency can be held virtually constant even when different numbers of active lines are used. Also, it is easy to change the frame frequency. Since the operating voltage and operation bias can be adjusted according to the number of active lines, a partial display can be made under proper operating conditions and thus power consumption can be reduced. In the above explanation, the process of conversion into alternating current, or a current that reverses the polarity of voltage given to the liquid crystal periodically, has been omitted. This process can be easily achieved by generating a signal to request AC conversion in the timing generator 107 and accordingly changing the output voltage level of data and scanning signals to an adequate level.

Next, referring to FIGS. 6 to 13, a second embodiment of the present invention will be detailed.

A liquid crystal display controller according to the second embodiment of the present invention enables gradation displays.

Figure 6:
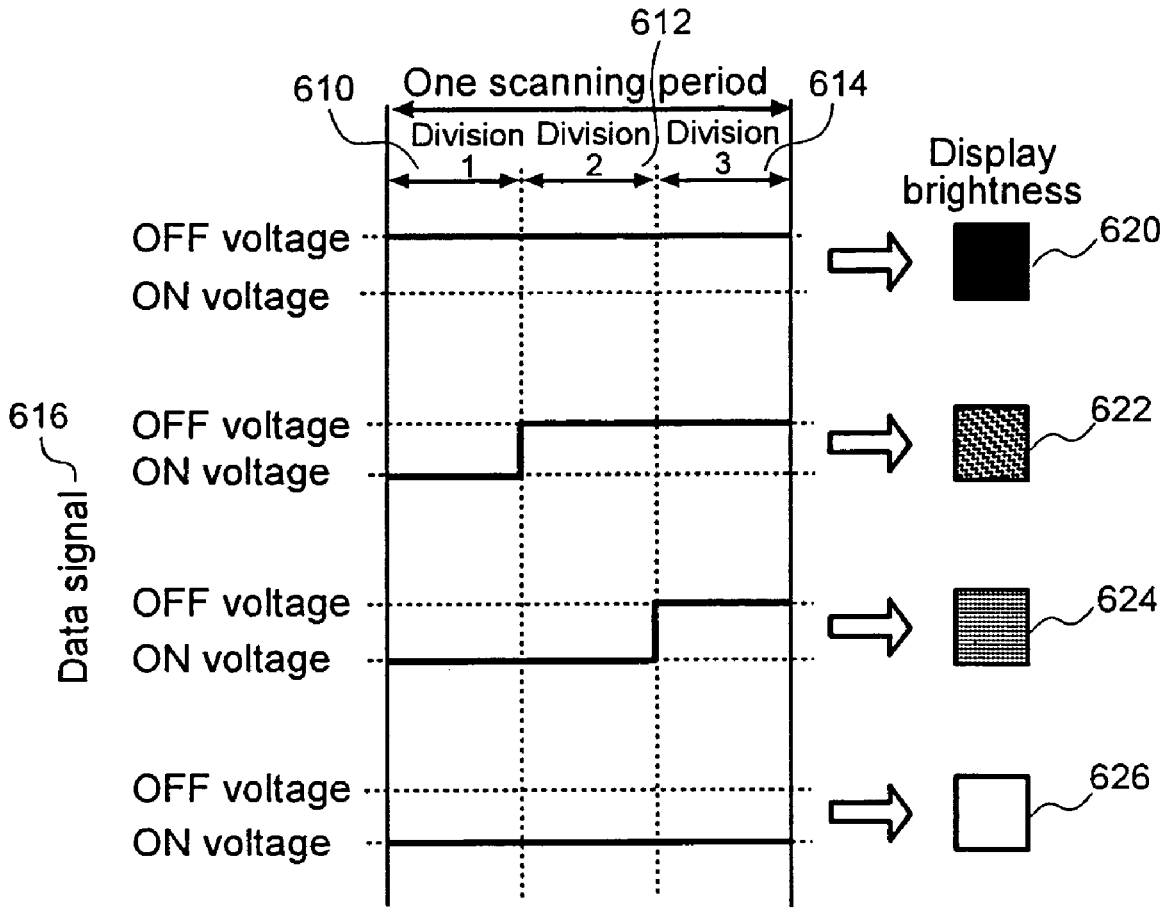
FIG. 6 illustrates the principles of the PWM method according to the second embodiment of the present invention.

PWM (pulse width modulation) is used as the gradation display method. In the PWM method, as shown in FIG. 6, regarding the data signals given to data lines on the liquid crystal panel, one scanning period is divided into two or more periods, e.g., 610, 612 and 614, and ON or OFF voltage is given to each divisional period, where the ratio of ON voltage to OFF voltage is determined by the gradation information included in the display data 616 (hereinafter referred to as gradation display data), so that intermediate display brightness can be obtained, e.g., 620, 622, 624, and 626.

Figure 7:
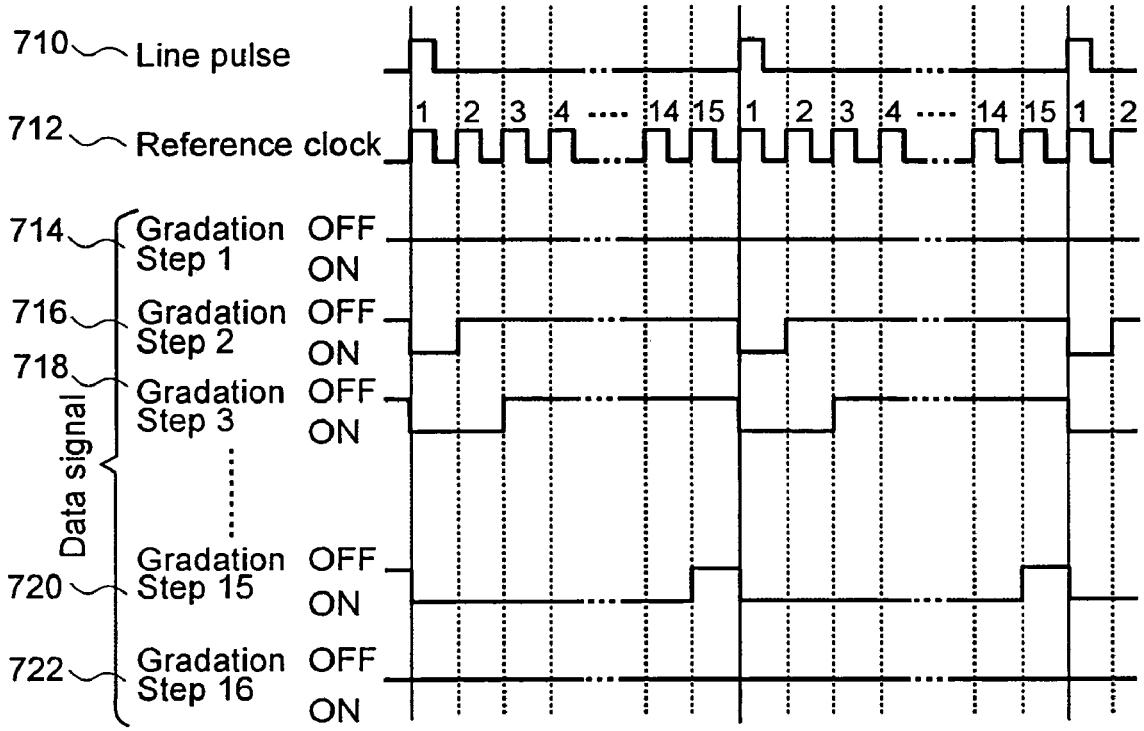
FIG. 7 is a timing diagram for the PWM method according to the second embodiment of the present invention.

Now, how the PWM method is applied to the liquid crystal display controller according to the second embodiment of the present invention in order to get 16 gradation steps is discussed next. Division of one scanning period, which is necessary for PWM, is easily done using the reference clock cycle 712. Since data signal is supplied to each data line while it is selected by the scanning signal, or over one scanning period as defined by a line pulse 710, in order to produce, for example, 16 gradation steps, for example, gradation step graphs 714, 716, 720, and 722, as shown in FIG. 7, the number of reference clocks 712 for one scanning period should be 15 and the ratios of ON voltage should be 0/15, 1/15, 2/15 and so on, up to 15/15.

As described earlier, in the liquid crystal display controller, the number of reference clocks for one scanning period is not fixed at 15 because the frame frequency is adjustable. So, if the number of reference clocks is less than 15, it is impossible to produce 16 gradation steps. Inversely, if the number of reference clocks is more than 15, the ratio of ON voltage cannot be increased consecutively and thus linear effective voltage characteristics cannot be realized.

Figure 8:
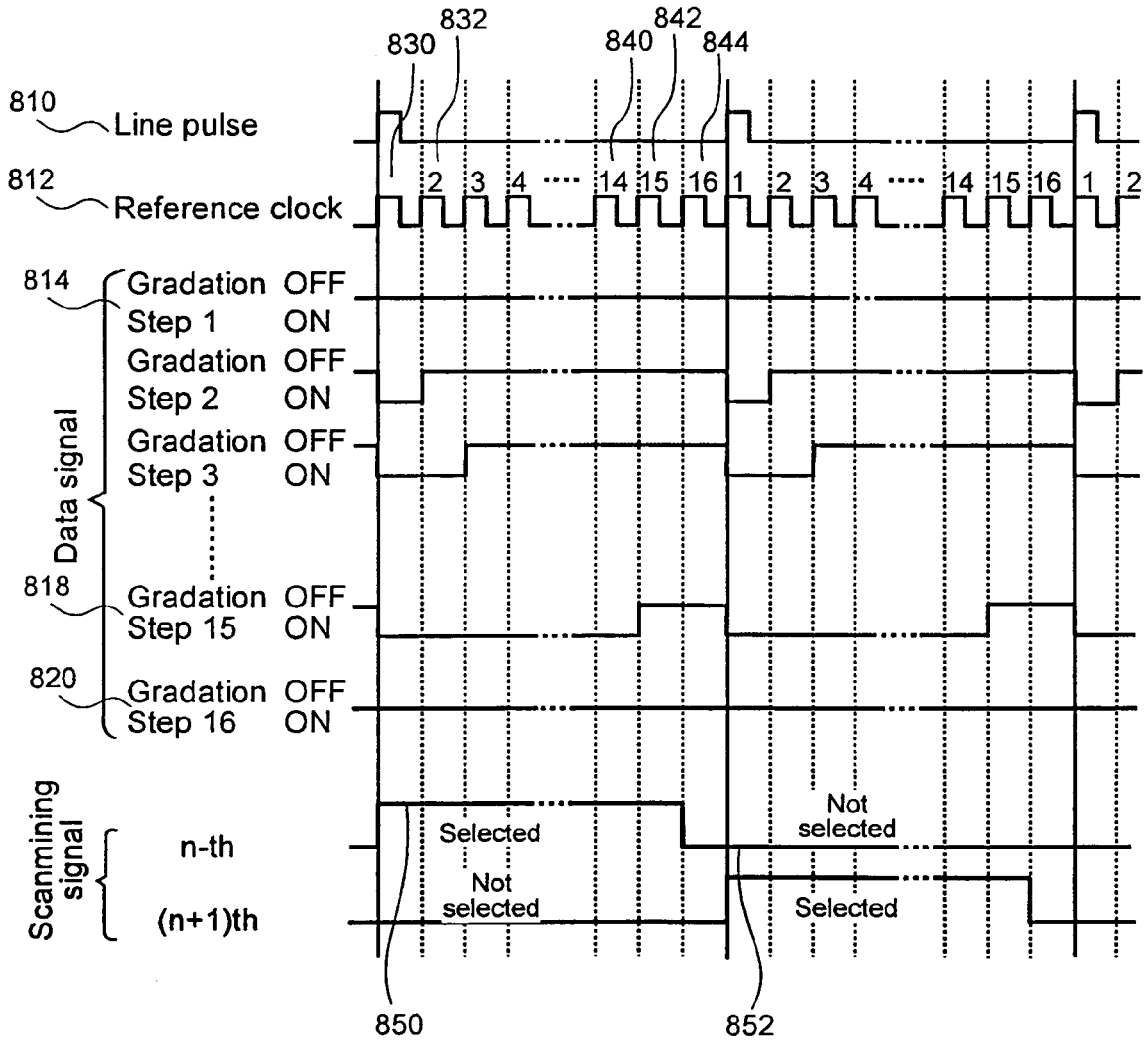
FIG. 8 is a timing diagram illustrating the operation of the liquid crystal display controller according to the second embodiment of the present invention.

One possible solution to this problem is as follows. In order to display m gradation steps, the number of reference clocks, n, should be (m−1) or more. This relation is expressed by n greater than or equal to (m−1). Accordingly, one scanning period is divided by n. Regarding linearity of effective voltage characteristics in case of n>(m−1), it should be noted that the ratio of ON voltage in the period of application of the selected voltage determines the effective voltage to be applied to the liquid crystal. It follows that if the selected voltage is given only to the first division through the (m−1)th one among the n divisions instead of the entire one scanning period, the same conditions as for the case of n=(m−1) can be obtained. Therefore, the following approach is taken: the first division through the (m−1)th division are assumed as an "effective" period and the remaining divisions as an "ineffective" period, and the ratio of ON voltage is consecutively increased in the effective period. For example, in order to use 16 divisions to express 16 gradation steps (for example, division 830 to division 16 844, and gradation step 1 814 to step 16 820), as shown in FIG. 8, gradation steps are produced by increasing the ratio of ON voltage consecutively from the first division 830 to the 15th division 842 and outputting the voltage of the 15th division 842, as it is, for the 16th division 844. In conjunction with this, as for scanning signals, the selected voltage 850 is outputted for the first division 830 to the 15th division 842 (effective period), while the non-selected voltage 852 is outputted for the 16th division 844 (ineffective period). The above problem can be solved by the approach as mentioned above.

The structure and operational sequence of the liquid crystal display controller as the second embodiment of the present invention will be described below.

Figure 9:
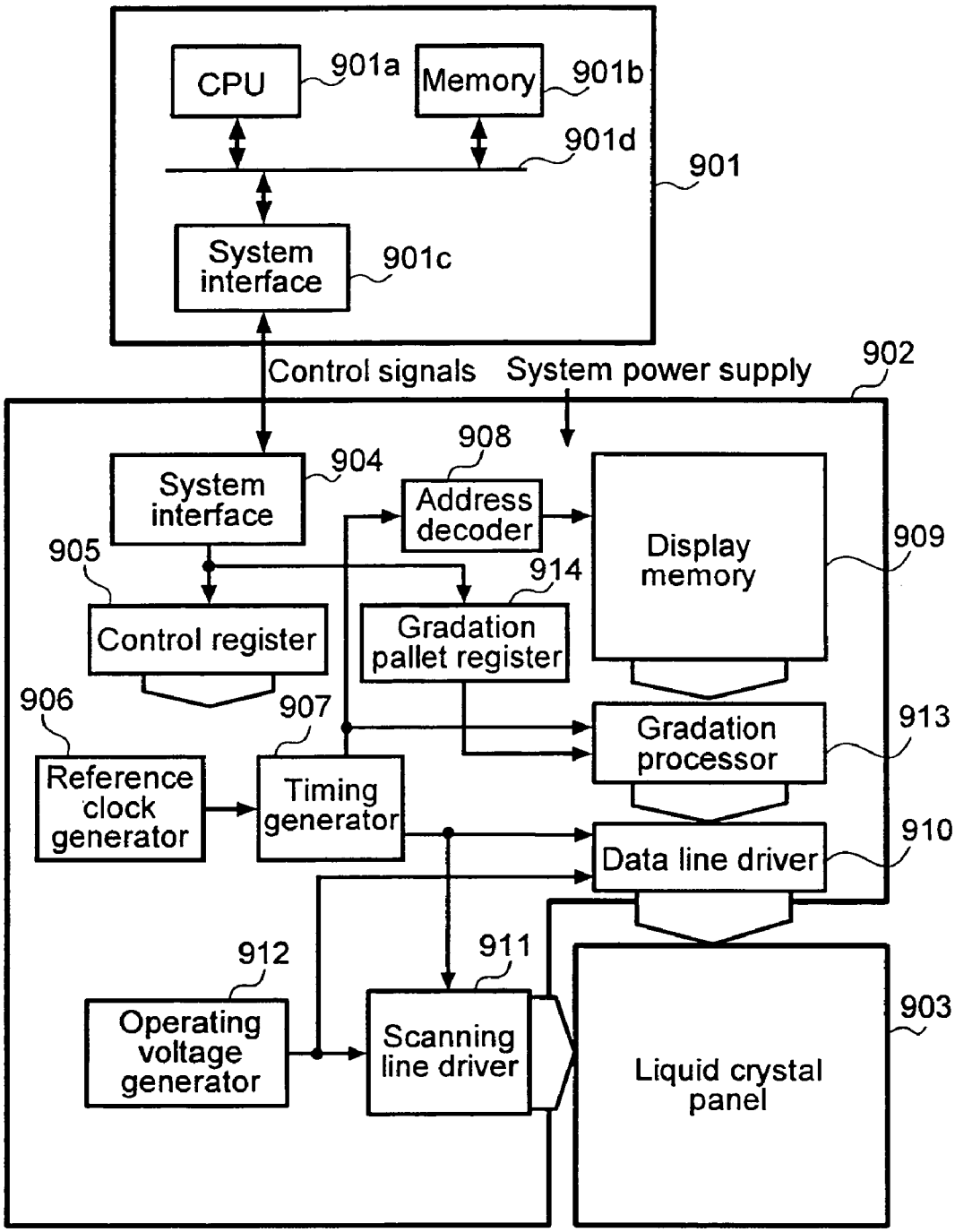
FIG. 9 is a block diagram showing the structure of the liquid crystal display controller according to the second embodiment of the present invention.

FIG. 9 is a block diagram for a liquid crystal display controller according to the second embodiment of the present invention, which also shows a connection with an external device. In FIG. 9, shows a data processor 901, a liquid crystal display controller 902, and a passive matrix color liquid crystal panel 903. The liquid crystal display controller 902 includes, a system interface 904, a control register 905, a reference clock generator 906, a timing generator 907, an address decoder 908, a display memory 909, a data line driver 910, a scanning line driver 911, an operating voltage generator 912, and a gradation processor 913 and a gradation pallet register 914.

First, the basic operations of the data processor 901, liquid crystal display controller 902, and liquid crystal panel 903 will be explained next.

The data processor 901, which is composed of an CPU 901*a*, a memory 901*b*, a system interface 901*c* and a bus 901*d* connecting these, gives the liquid crystal display controller 902 the following data: gradation display data to display images on the liquid crystal panel 903, various operating parameters for the liquid crystal panel 903 and gradation pallet data. These operating parameters are the same as for the structure shown in FIG. 2. Regarding gradation display data, since images are to be displayed in color in this embodiment, one pixel has eight bits of color information, where three bits are allocated to each of red (R) and green (G) and two bits to blue (B). Gradation pallet data is base data that determines which gradation step corresponds to the color specified by gradation display data. The data processor 901 selects a total of 20 types of gradation data—8 for each of R and G (3 bits), and 4 for blue (2 bits)—from the gradation pallet data for 16 gradation steps for each of R, G and B, and gives them to the liquid crystal display controller 902. This makes it possible to choose 256 colors (8 bits of color information per pixel) from 4096 colors (16 gradation steps for each of R, G and B) and display them. The sequence for the data processor 901 to give data to the liquid crystal display controller 902 is the same as for the liquid crystal display controller shown in FIG. 2.

The liquid crystal display controller 902 stores the display data, various operating parameters and gradation pallet data as given by the data processor 901, in the display memory 909, the control register 905, and the gradation pallet register 914, respectively. According to the stored operating parameters, it reads gradation display data from the display memory 909, converts it into PWM signal for each of R, G and B according to the gradation pallet data. Further, the PWM signals are converted into data signals and outputted; the corresponding scanning signals are also outputted.

As the R, G, and B data signals given by the liquid crystal display controller 902 are sent to the data lines corresponding to R, G, and B color filters and scanning signals are sent to scanning lines, the liquid crystal panel 903 displays images.

It is assumed here that the waveforms for the data and scanning signals are in accordance with liquid crystal operating voltage waveforms stated on pp. 394-399 of the Liquid Crystal Device Handbook, edited by the 142nd Committee of the Japan Society for the Promotion of Science and published by Nikkan Kogyosha, as in the case of the first embodiment of the present invention.

With the above-mentioned structure and operational sequence, the liquid crystal display controller according to the second embodiment of the present invention can hold the frame frequency virtually constant with different numbers of active lines. In addition, a PWM-based multi-color display can be made.

Next, further details of the operational sequence of the liquid crystal display controller 902 will be given.

Descriptions of the system interface 904, control register 905, reference clock generator 906, address decoder 908 and operating voltage generator 912 are omitted here because their structures and operations are the same as those in the liquid crystal display controller shown in FIG. 2.

Like the timing generator 107 in FIG. 2, the timing generator 907 generates line pulses, frame pulses and display memory read addresses. In addition, it produces a gradation enable signal to specify whether it is an effective period or an ineffective period as mentioned earlier, and outputs it to the gradation processor 913 and the scanning line driver 911.

Figure 10:
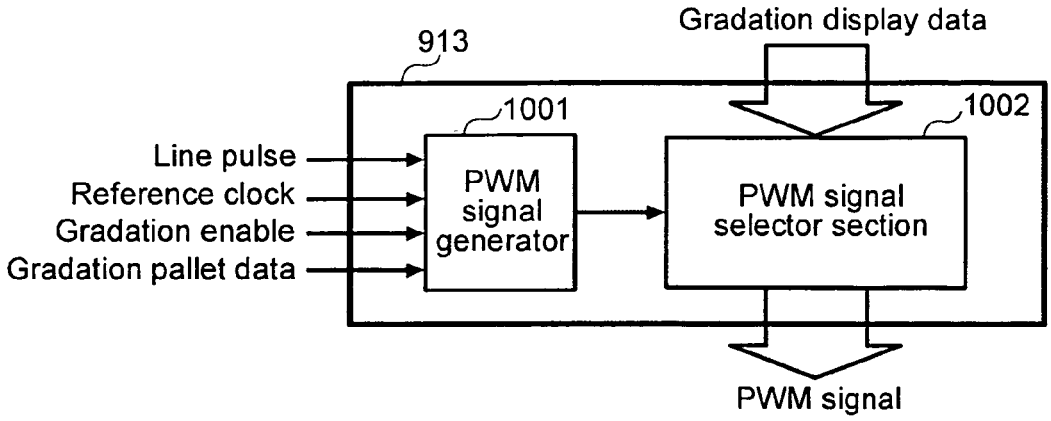
FIG. 10 is a block diagram showing the structure of the gradation processor according to the second embodiment of the present invention.
Figure 11:
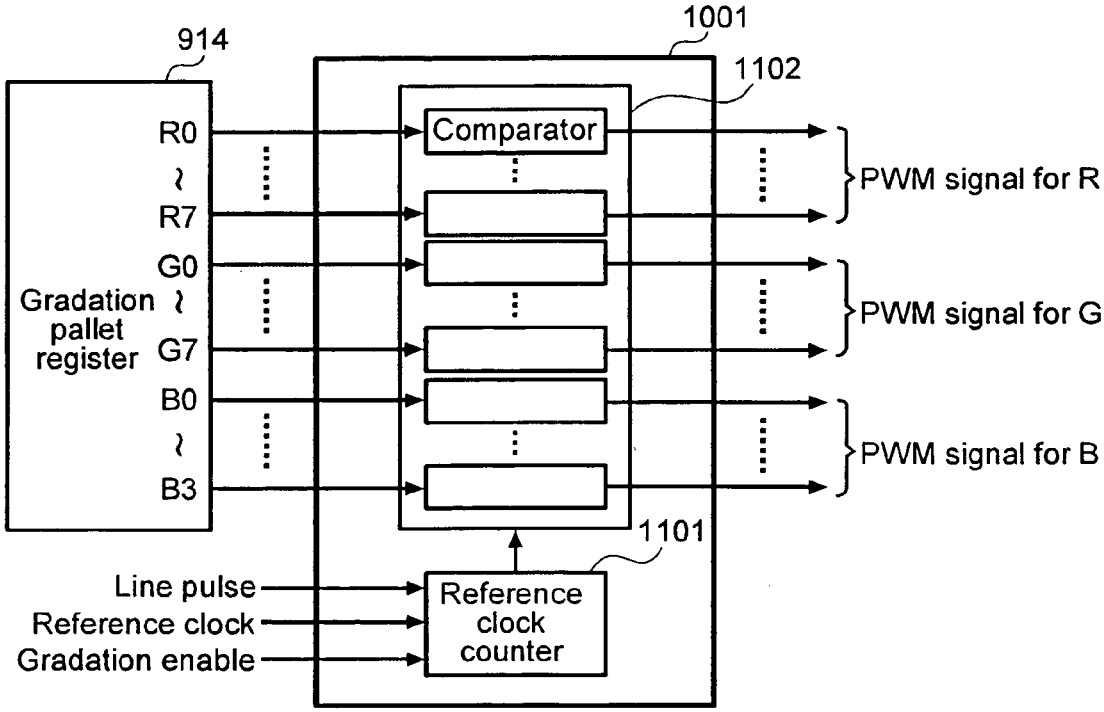
FIG. 11 is a block diagram showing the structure of the PWM signal generator according to the second embodiment of the present invention.
Figure 12:
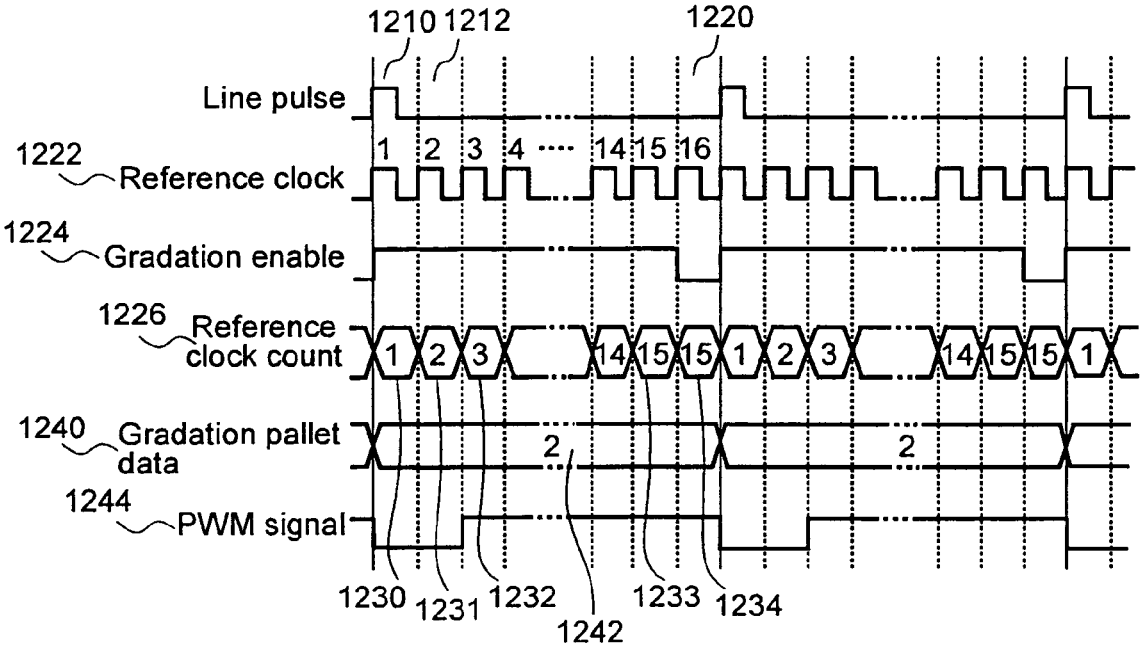
FIG. 12 is a timing diagram illustrating the operation of the PWM signal generator according to the second embodiment of the present invention.
Figure 13:
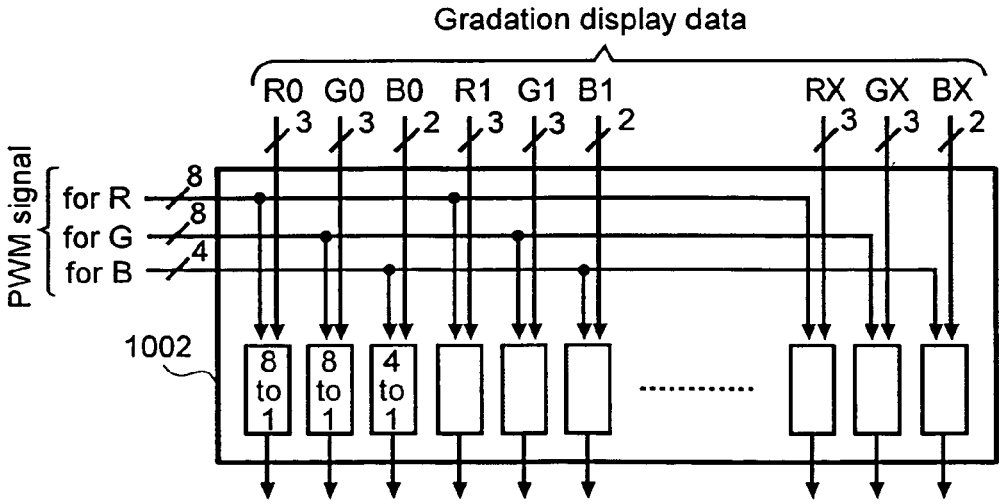
FIG. 13 is a block diagram showing the structure of the PWM signal selector section according to the second embodiment of the present invention.

As shown in FIG. 10, the gradation processor 913 consists of a PWM signal generator 1001 and a PWM signal selector section 1002. As shown in FIG. 11, the PWM signal generator is composed of a reference clock counter 1101 and a comparator section 1102. Line pulse, reference clock and gradation enable signal are sent to the reference clock counter. It is reset by line pulse and increments the count synchronously with the reference clock while the gradation enable signal is active. When one scanning period is divided into, for example, 16 divisions to display 16 gradation steps, e.g., division 1 1210, division 2 1212, to division 16 1220, as shown in FIG. 12, it is reset to 1 by the line pulse, then after counting up to 15, count 15 1233 is outputted as it is in the remaining period 1234. This reference clock count value 1226 and the gradation pallet data 1240 given by the gradation pallet register 914 are sent to the comparator section 1102. If (count)=<(gradation pallet data), "low" PWM signal is outputted; if (count)>(gradation pallet data), "high" PWM signal is outputted. As shown in FIG. 12, if the gradation pallet data is "2" 1242, the PWM signal 1244 is "low" for counts 1 1230 and 2 1231, while it is "high" for counts from 3 1232 to 15 1233 (and 1234). Because there are a total of 20 types of gradation pallet data (8 for each of R and G, and 4 for B), the PWM signal generator 1001 generates 20 types of PWM signals that correspond to the different types of gradation pallet data. On the other hand, in the PWM signal selector section 1002, two "8 to 1" selectors (for R and G) and one "4 to 1" selector (for B) are provided for each pixel and as many such selector sets as pixels in each line are provided, as shown in FIG. 13. It selectively outputs PWM signal according to the gradation display data for one line, as read from the display memory 909.

When the PWM signal given by the gradation processor 913 is "low," the data line driver 910 converts it into ON voltage and, when it is "high," into OFF voltage before outputting it as data signal to a data line on the liquid crystal panel 903.

Frame and line pulses and a gradation enable signal are inputted to the scanning line driver 911, and according to these signals, selected or non-selected voltage is outputted as scanning signal to a scanning line on the liquid crystal panel 903. Selected voltage is applied synchronously with the frame pulse to give selected voltage to the top line; then it is applied to subsequent lines synchronously with the line pulse.

The selected voltage is applied only when the gradation enable signal is active; in the remaining period, non-selected voltage is always applied.

As mentioned above, the liquid crystal display controller 902 works to hold the frame frequency virtually constant with different numbers of active lines, like the liquid crystal display controller in FIG. 2. Also, it is easy to change the frame frequency. In addition, as shown in FIG. 8, it is possible to output data signals and scanning signals, so linear effective voltage characteristics can be achieved by the PWM method.

It should be noted that the number of colors, the number of gradation steps and the number of divisions of one scanning period are given above by way of example for this second embodiment of the present invention and not as a limitation on the invention.

In the second embodiment of the present invention, PWM is used for gradation control but it should be interpreted as illustrative only, not as limitative of the invention. Alternatively, it is possible to employ the FRC (frame rate control) method in which several frames are treated as one unit and the number of frames for display ON or OFF is limited therein. If this method is employed, ON voltage and OFF voltage cannot coexist within one scanning period; instead, either voltage is applied. Therefore, it is not necessary to divide one scanning period into an effective period and an ineffective one.

Next, referring to FIGS. 14 to 18, a third embodiment of the present invention will be described.

In a liquid crystal display controller according to the third embodiment of the present invention, higher image quality and lower power consumption are realized for PWM.

Figure 14:
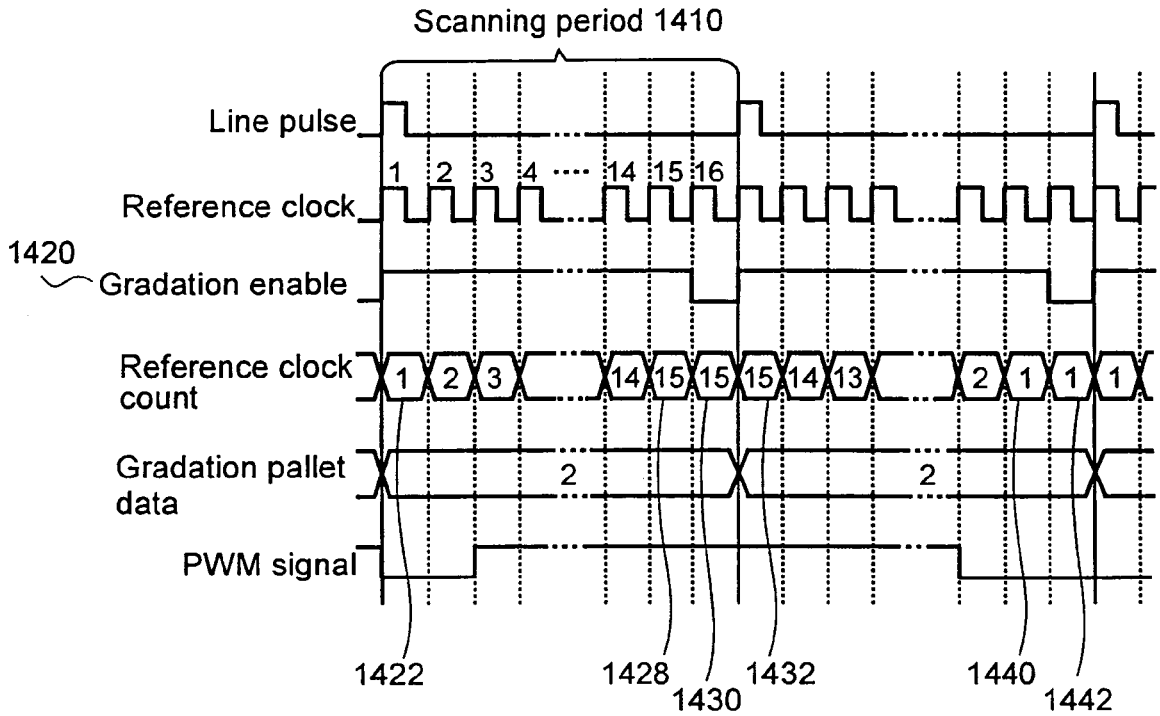
FIG. 14 is a timing diagram illustrating the operation of a liquid crystal display controller according to the third embodiment of the present invention.

In every data signal used by the PWM method shown in FIG. 8, except ones for black and white, there are two points of change in voltage level within one scanning period. This is because one scanning period begins with ON voltage and ends with OFF voltage. Therefore, it is not unreasonable to think that by inverting this order every scanning period, the number of data signal changes can be halved. This will halve the power consumed for charge/discharge of the liquid crystal, thereby reducing power consumption. To achieve this, for instance, after the reference clock count 1420 is incremented from 1 1422 in a scanning period 1410, it should be decremented from 15 1432 in the next scanning period, as shown in FIG. 14.

Figure 15A:
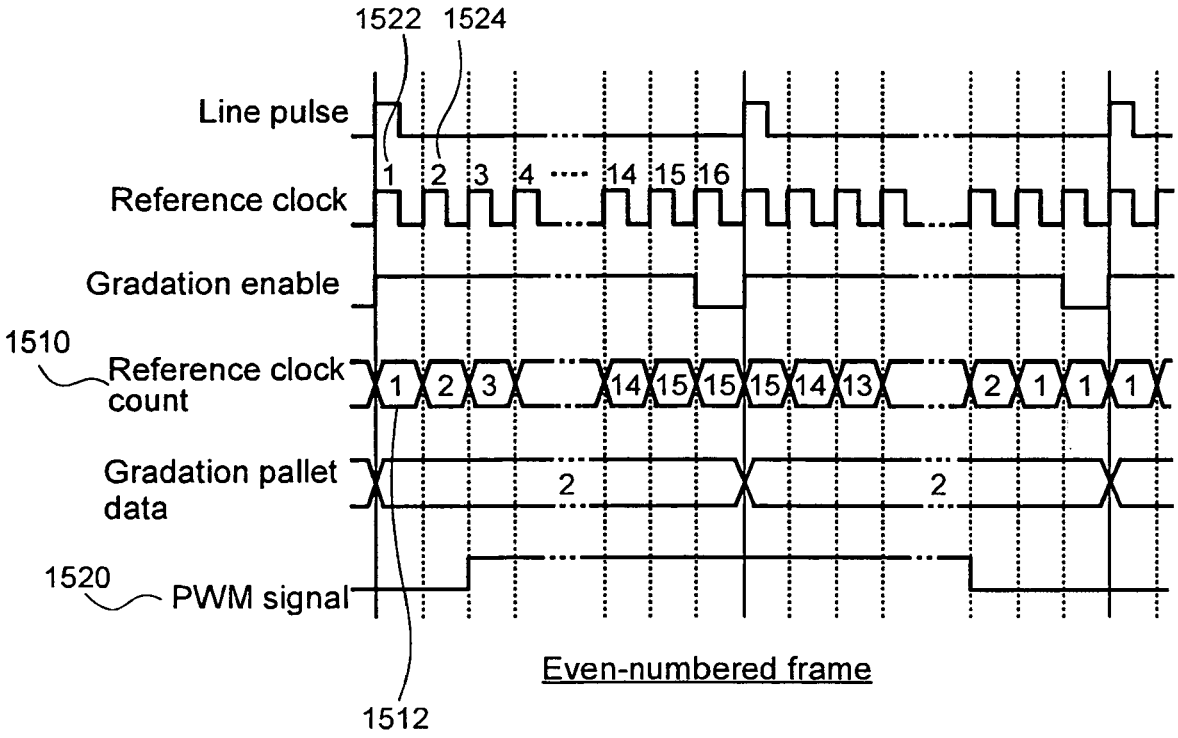
FIGS. 15*a* and 15*b* are timing diagrams illustrating the operation of a liquid crystal display controller according to the third embodiment of the present invention.
Figure 15B:
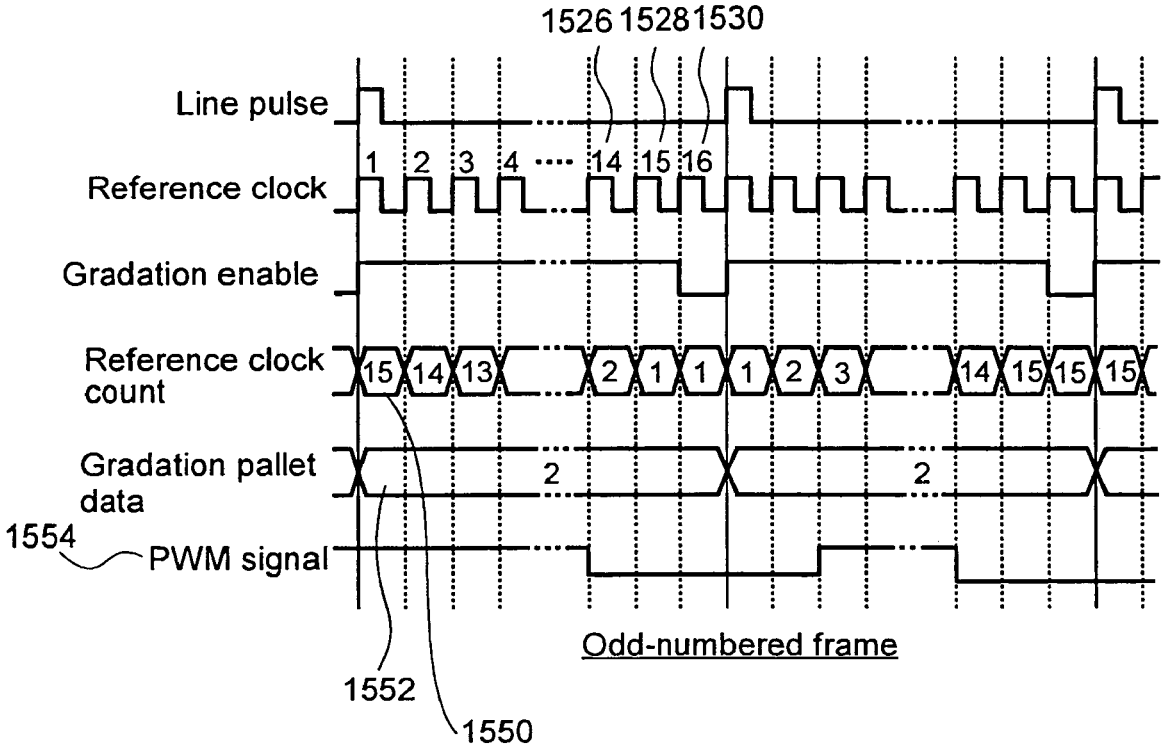

If there is a time lag between data signal output and scanning signal output, the effective voltage applied to the liquid crystal may be different depending on whether one scanning period begins with ON voltage or OFF voltage. For this reason, even if the same gradation is displayed, the shading may vary from line to line. As a solution to this problem, two starting modes are used, one in which one scanning period begins with ON voltage and the other in which it begins with OFF voltage, and a switch occurs from one mode to the other every frame to the average applied effective voltages as shown in FIGS. 15*a* and 15*b*. For example, as shown in FIG. 15*a*, for a scanning period in which the reference clock count 1510 is incremented from 1 1512 in an even-numbered frame, it should be decremented from 15 1550 in an odd-numbered frame (FIG. 15*b*). In other words, when gradation pallet data 2 1552 is supplied, in case of even-numbered frames (FIG. 15*a*), the PWM signal 1520 is "low" at reference clocks 1 1522 and 2 1524 in the first scan line of the first (even) frame, while the PWM signal 1554 is "low" at reference clocks 14 1526, 15 1528 and 16 1530 in the first scan line of the second (odd) frame. Since reference clock 16 1530 is not selected, data is supplied effectively for two pulses of reference clock in each frame. Likewise, in case of odd-numbered frames, the PWM signal 1554 is "low" at reference clocks 14 1526, 15 1528 and 16 1530 in the first scan line of the first (odd) frame, while it 1520 is "low" at reference clocks 1 1522 and 2 1524 in the first scan line of the second (even) frame. Here, since reference clock 16 1530 is not selected in the first (odd) frame, gradation pallet data 2 becomes unavailable.

Figure 16:
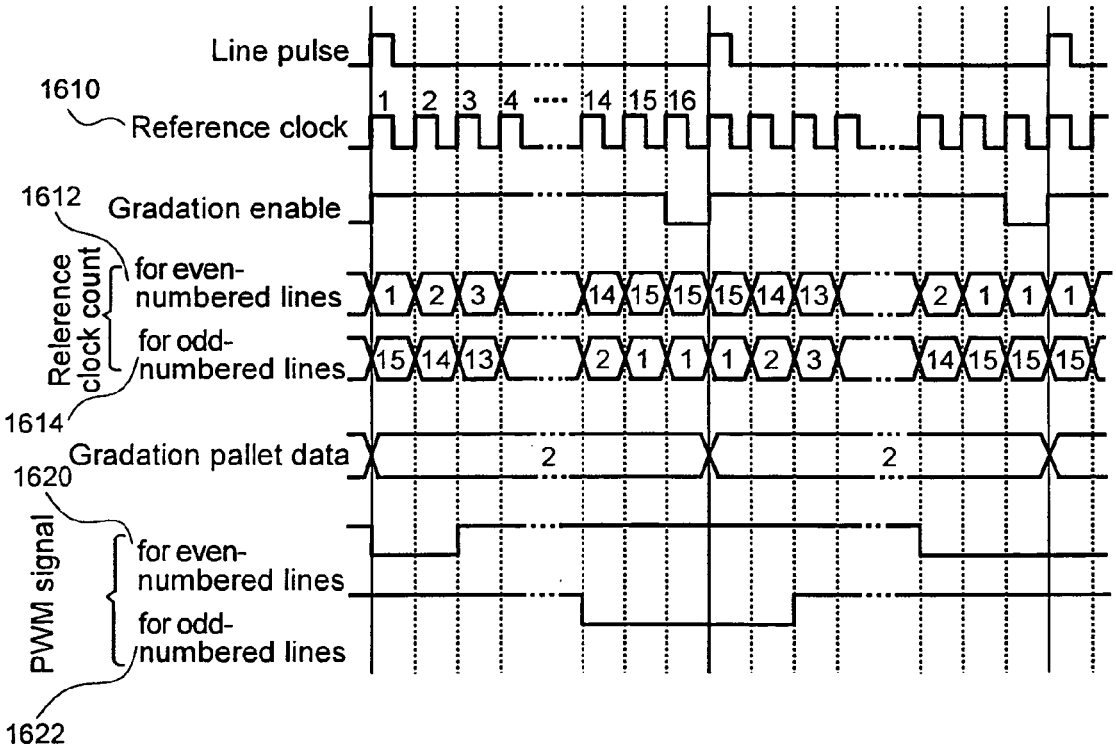
FIG. 16 is a timing diagram illustrating the operation of a liquid crystal display controller according to the third embodiment of the present invention.
Figure 17:
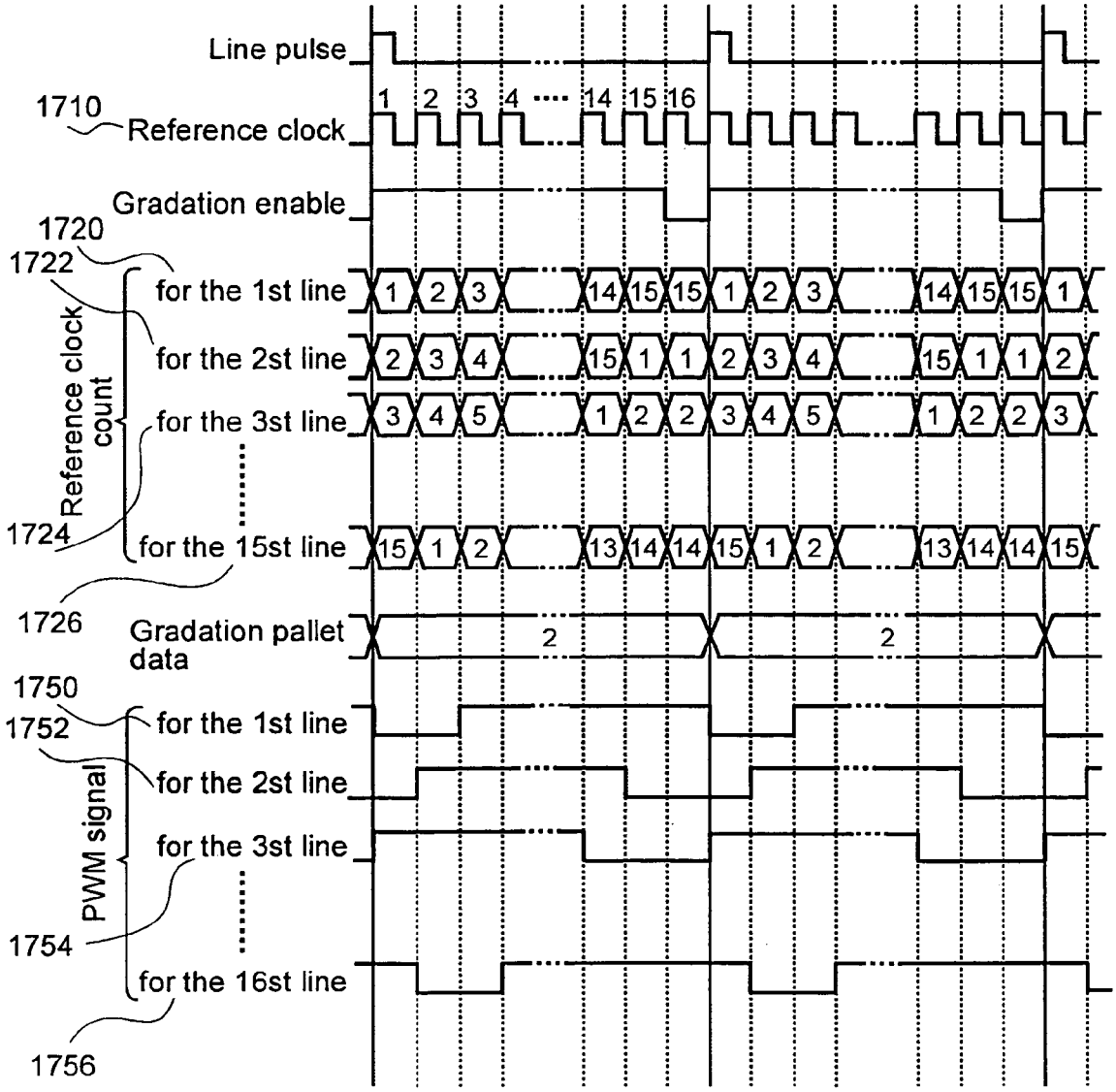
FIG. 17 is a timing diagram illustrating the operation of a liquid crystal display controller according to the third embodiment of the present invention.

In addition, in case of the data signals shown in FIG. 15, if the same gradation is displayed, the voltage level changes at the same timing for all data lines. Consequently, a large peak current flows temporarily. One solution to decreasing the peak current may be that the timing of data signal change should be varied from data line to data line. One example of such solution is as shown in FIG. 16. Here, two types of reference clock counters are used, one 1612 for even-numbered data lines 1620 and the other 1614 for odd-numbered data lines 1622, and the incrementing and decrementing timings for one counter are the reverse of those for the other. This produces a phase difference of 180 degrees in applied data signal between even-numbered data lines 1620 and odd-numbered ones 1622. A further development of this approach is that, as shown in FIG. 17, several reference clock counters (for example 1720, 1722, 1724, 1726) are provided and their count timings are varied in increments of one reference clock for dispersion of data signal voltage level variation (for example 1750, 1752, 1754, 1756).

Figure 18A:
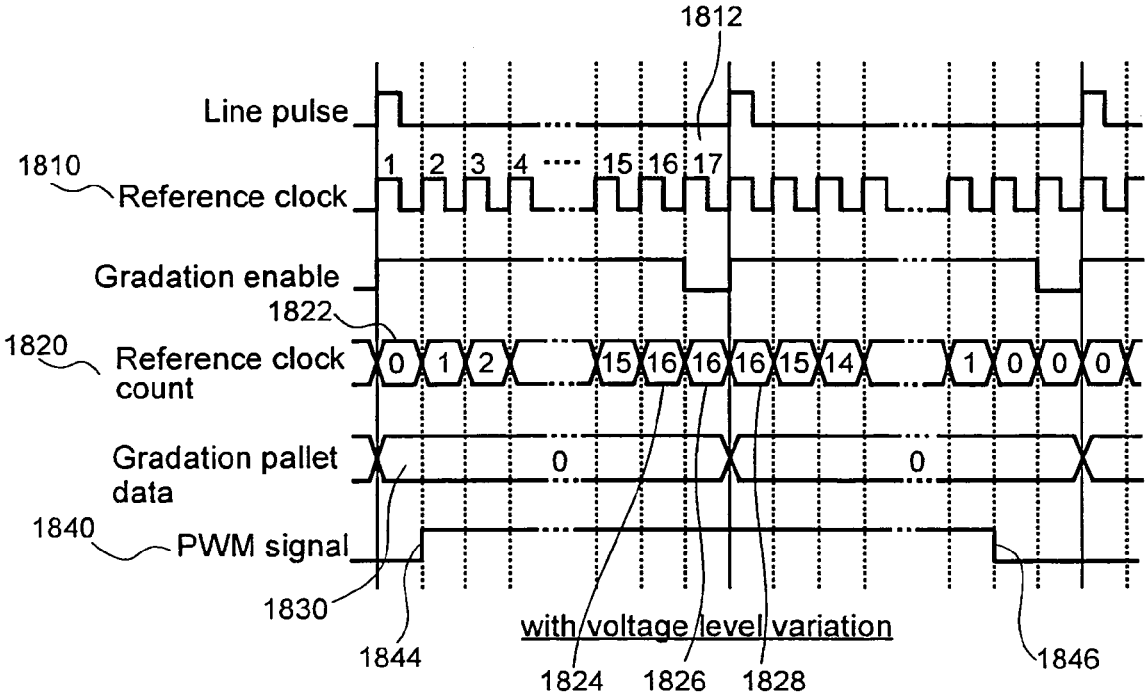
FIGS. 18*a* and 18*b* are timing diagrams illustrating the operation of a liquid crystal display controller according to the third embodiment of the present invention.

Another problem is that because, with data signals used for PWM as discussed above, there is no voltage level variation for black and white, an image which contains both gradation (excluding black and white) and black or white may have some display unevenness attributable to differences in the number of voltage level changes. This problem can be solved by varying the data signal voltage level for black and white in the same way as for gradation. Therefore, as illustrated in FIG. 18*a*, the number of reference clocks 1810 for the effective period is set at 17 1812 instead of at 16 and the counter 1820 is preset so as to count from 0 1822 to 16 1824 (and 1826). This ensures that, even if the gradation pallet data is "0" 1830 (black), the PWM signal voltage level changes once for one scanning period, as shown in FIG. 18*a* PWM signal change 1844 and 1846 (compare with PWM signal 1850 in FIG. 18*b*).

Figure 18B:
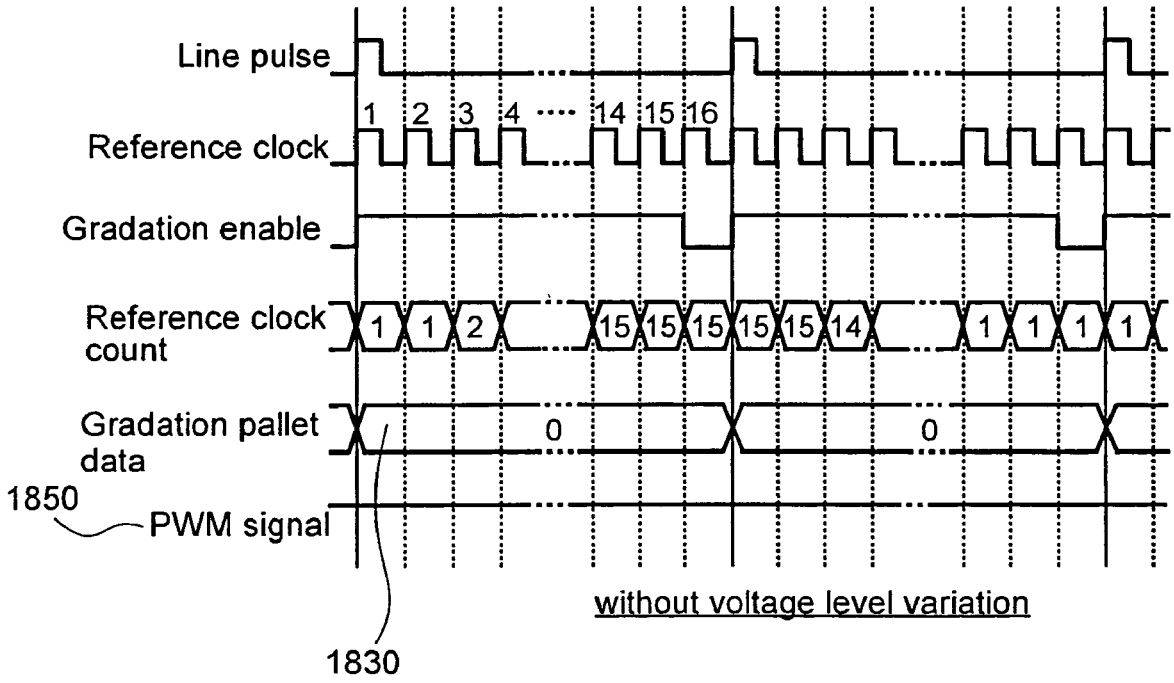

In this case, as the data signal voltage level is changed for black or white, power consumption increases. Here, the question is whether we should trade off the elimination of display unevenness for reduction of power consumption or vice versa. An embodiment of the present invention provides a means for choosing whether or not to change the voltage level of data signal for black and white. Specifically, as shown in FIG. 18*b*, when the data signal voltage level is not to be changed, the reference clock counts "0" and "16" should be replaced by "1" and "15," respectively. This can be accomplished by giving an instruction from the external data processor as in setting operating parameters as mentioned earlier.

The above-mentioned embodiments may be combined in any manner. In addition to the operating parameters as mentioned in embodiments of the present invention, the introduction of various other parameters such as contrast control and a function to turn off the display is possible. These parameters can be easily made usable by the above-mentioned method used in embodiments of the present invention in which preset data is given to the control register from the external data processor and various blocks are controlled according to the data. Although the liquid crystal display controller described in embodiments of the present invention is assumed to consist of one LSI chip, the present invention is not limited thereto: it is possible that the controller consists of two or three chips dedicated to different functions.

Figure 19:
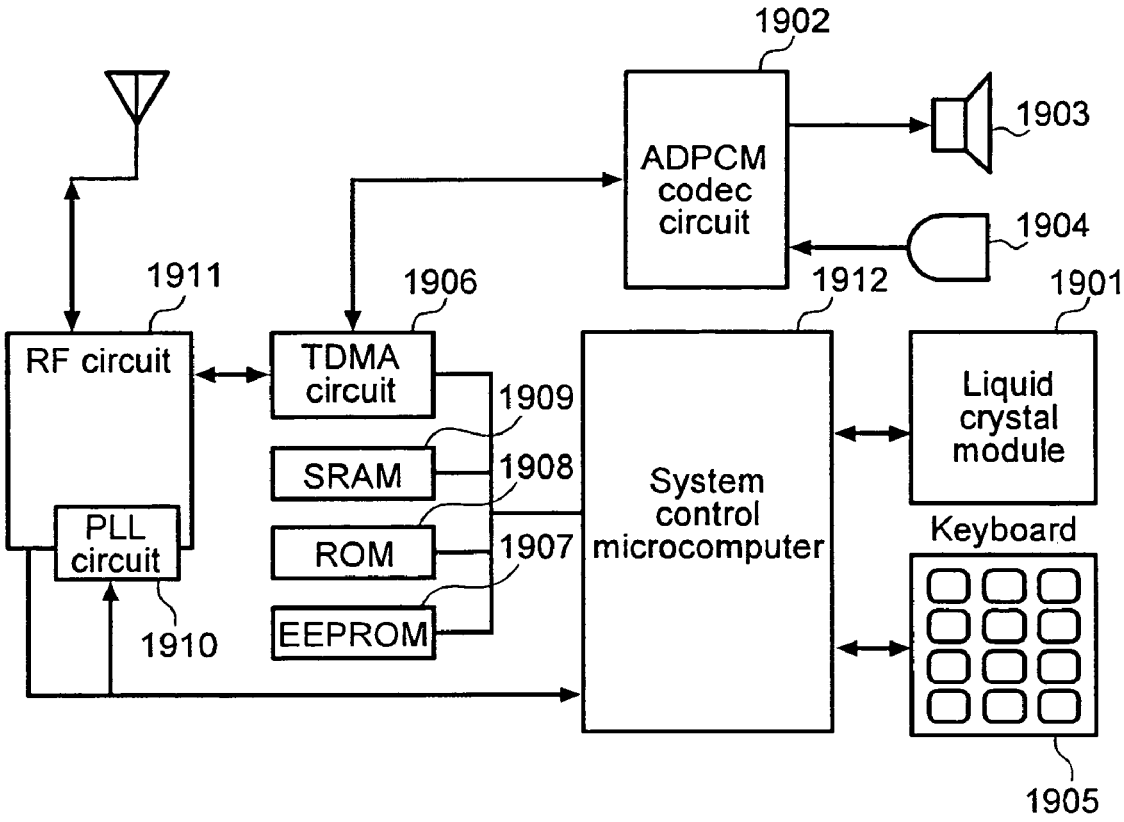
FIG. 19 is a block diagram showing the structure of a cellular phone system according to the fourth embodiment of the present invention.

Next, a fourth embodiment of the present invention will be described by reference to FIG. 19.

The fourth embodiment of the present invention concerns a liquid crystal display controller used in a cellular phone system. FIG. 19 is a block diagram illustrating the structure of the cellular phone system of an embodiment of the present invention. In the figure, 1901 represents a liquid crystal module which comprises a liquid crystal panel and a liquid crystal display controller according to the forth embodiment of the present invention, 1902 an ADPC codec circuit for compression and decompression of voice sound, 1903 a speaker, 1904 a microphone, 1905 a keyboard, 1906 a TDMA circuit for time division multiplexing of digital data, 1907 an EEPROM which stores registered ID numbers, 1908 a ROM which stores the program, 1909 an SRAM for temporary storage of data or as a work area for the microcomputer, 1910 a PLL circuit which sets carrier frequencies for radio signals, 1911 an RF circuit for transmission and reception of radio signals, and 1912 a system control microcomputer.

In the cellular phone system according to the fourth embodiment of the present invention, for example, a message by e-mail or a stored telephone directory is displayed on the whole screen while a display is made only on part of the screen during standby or in the dormant state. It is assumed here that for switching of the full and partial screen display states, the system control microcomputer 1912 works in accordance with a key entry by the operator or incoming electric wave conditions and the system is pre-programmed so as to send information on the required number of active lines to the liquid crystal module 1901. In conjunction with this, the ratio of division of the original clock, the number of clocks per scanning period and other operating parameters are also delivered to the liquid crystal module 1901. Regarding how the original clock division ratio and the number of clocks per scanning period should be decided in relation to the number of active lines determined by the system control microcomputer 1912, it is desirable to prepare a table, for example, like the one shown in FIG. 1, and pre-program the system so as to make reference to this look-up table to decide these parameters. This table data is stored together with the program in the ROM 1908. Also, other parameters can be determined by preparing adequate tables in relation to the number of active lines.

Through the above sequence of operations, the cellular phone system according to the fourth embodiment of the present invention can switch the display mode from the full-screen mode to the partial-screen one or vice versa depending on the application purpose. This means that if you need not display an image across the entire screen, only the required part of the screen is used for displaying it, permitting you to reduce power consumption. Furthermore, the cellular phone system according to the fourth embodiment of the present invention can hold the frame frequency (operating frequency for the liquid crystal module) almost constant, whether it is in either a full-screen display mode or a partial-screen one. This can prevent image quality deterioration due to increase in frame frequency.

Besides, in the cellular phone system according to the fourth embodiment of the present invention, it is possible to change the frame frequency during a full screen display. The purpose of this frequency change is to realize two operation modes: a contrast-oriented mode that uses a higher frame frequency and a power saving mode that uses a lower frame frequency. This can be achieved when the system control microcomputer 1912 (which corresponds to the data processor 101 or 901) sends the liquid crystal module 1901 information on original clock division ratios and the number of clocks per scanning period that make the frame frequency high during operation of the system and low in its dormant state. Regarding how to determine the original clock division ratio and the number of clocks per scanning period for each mode, it is desirable to prepare a table, for example, like the one shown in FIG. 1, and pre-program the system to make reference to this table to decide these parameters.

Through the above sequence of operations, the cellular phone system according to the fourth embodiment of the present invention can change the frame frequency for the liquid crystal module depending on the application purpose. This means that during operation of the system by the operator or in similar circumstances, a higher frame frequency is used for high quality images, while in the dormant state, the system is run at a lower frame frequency to reduce power consumption of the liquid crystal module.

As a matter of course, it is possible to combine the above-mentioned full/partial screen display modes and high/low frame frequency operation modes.

In another embodiment of the present invention a computer program product stored on a computer readable medium for changing a scanning period used in a liquid crystal display is provided. The computer program product includes: code for determining a reference clock period from a first number of original clock periods; code for determining said scanning period from a second number of said reference clock periods; and code for changing said scanning period by at least one reference clock periods. In an alternate embodiment of the present invention a computer program product stored on a computer readable medium for maintaining a frame frequency at a substantially constant value for a liquid crystal display, having different numbers of active scan lines is provided. This computer program product includes: code for selecting a first number of said different numbers of scan lines, wherein each scan line period for said first number is based on a second number of reference clock periods; and code for determining said second number such that the inverse of a product is substantially equal to said frame frequency, wherein said product comprises said first number multiplied by said second number multiplied by a reference clock period.

The above embodiments have one or more of the following features and/or advantages. A liquid crystal display controller can achieve reduction of power consumption by enabling images to be displayed only on desired parts of the screen. In addition the frame frequency can be easily changed according to the characteristics of the liquid crystal panel so that a satisfactory display contrast, which depends on the characteristics of the liquid crystal panel, can be achieved. Also, the liquid crystal display controller can conserve power and display a gradation image with a satisfactory contrast. Furthermore, it is possible to display a high quality image on a desired part of the screen with low power consumption during standby or data communication in a cellular phone system.

Although the above functionality has generally been described in terms of specific hardware and software, it would be recognized that the invention has a much broader range of applicability. For example, the software functionality can be further combined or even separated. Similarly, the hardware functionality can be further combined, or even separated. The software functionality can be implemented in terms of hardware or a combination of hardware and software. Similarly, the hardware functionality can be implemented in software or a combination of hardware and software. Any number of different combinations can occur depending upon the application.

Many modifications and variations of the present invention are possible in light of the above teachings. Therefore, it is to be understood that within the scope of the appended claims, the invention may be practiced otherwise than as specifically described.

What is claimed is:

1. A display control device capable of adjusting a frame frequency of a display panel coupled to the display control device, the display control device comprising:

a system interface for receiving display data from an external device;

a memory for storing the display data;

a register capable of storing from the external device a division ratio, a number of a second clock signal per a scanning period, and a number of active lines of the display panel;

a signal generator for dividing a first clock signal by the division ratio to generate the second clock signal, and for generating a signal having the frame frequency based on the second clock signal, the number of the second clock signal per the scanning period and the number of active lines of the display panel stored in the register;

a voltage generator for generating a plurality of driving voltage signals, and a data line driver for converting the display data into one of the plurality of driving voltage signals generated by the voltage generator to be provided to the display panel according to the frame frequency.

2. A display control device according to the claim 1 further comprising a clock generator for providing the first clock signal using an oscillator.

3. A display control device according to the claim 1, wherein the signal generator generates a signal synchronized with the scanning period based on the second clock signal and the stored number of the second clock signal per the scanning period, and wherein the display control device further comprises a scanning line driver for providing a selecting voltage and a non-selecting voltage to scan the active lines on the display panel according to the scanning period.

* * * * *